United States Patent [19]

Burnett et al.

[11] Patent Number: 4,696,512

[45] Date of Patent: Sep. 29, 1987

[54] MOTORIZED RECLINER CHAIR WITH RELEASE MECHANISM

[75] Inventors: William Burnett, Livingston; James R. Houghton; David A. Walker, both of Cookeville; Larry Key, Livingston, all of Tenn.

[73] Assignee: Berkline Corporation, Morristown, Tenn.

[21] Appl. No.: 836,709

[22] Filed: Mar. 6, 1986

[51] Int. Cl.[4] ..... A47C 1/035

[52] U.S. Cl. ..... 297/68; 297/69; 297/84; 297/330

[58] Field of Search ..... 297/68, 69, 84, 88, 297/330, 430; 74/527

[56] References Cited

U.S. PATENT DOCUMENTS 2,533,595 12/1950 Luketa ..... 297/330
4,365,836 12/1982 Jackson et al. ..... 297/68 X
4,386,803 6/1983 Gilderbloom ..... 297/84

FOREIGN PATENT DOCUMENTS 2953352 12/1980 Fed. Rep. of Germany ..... 297/330

*Primary Examiner*—Kenneth J. Dorner
*Assistant Examiner*—Peter R. Brown
*Attorney, Agent, or Firm*—David D. Kaufman

[57] ABSTRACT

A motor driven recliner chair in which a power transfer or drive tube is rigidly connected to the linkage actuating arms and operationally connected to the power screw of the motor by a nut threaded on the screw and slidably but non-rotatably positioned in the drive tube. A spring-biased latching member is pivotally mounted on the drive tube and captively retains the nut in the power screw-engaged position. The latching member may be withdrawn by the chair occupant whereupon the power drive is effectively disengaged and the chair may be manually operated to quickly return to the upright position.

15 Claims, 10 Drawing Figures

MOTORIZED RECLINER CHAIR WITH RELEASE MECHANISM

TECHNICAL FIELD

This invention relates to recliner chairs and/or sofas and, more particularly, to recliner chairs having motor means for driving the chairs between their upright and recline positions. More specifically, the invention relates to a motorized recliner chair having a mechanism for selectively disengaging or decoupling the motor drive to permit manual operation of the chair.

BACKGROUND OF THE INVENTION

In the present application, the expression "recliner chair" is used in its broadest sense and is meant to include all forms of motion seats capable of reclining, such as, chairs, sofas and loveseats.

Recliner chairs are well known and enjoy widespread usage in the home and office. In general, a recliner chair comprises a stationary base, a movable seat-footrest assembly and a linkage mechanism interconnecting the base and seat-footrest assembly. Most frequently, such recliner chairs are manually operable by the occupant in a variety of well known ways, such as, pushing on the armrests, leaning backward against the backrest, manipulation of a side handle, pressing down with the legs on the extended footrest, or the like. Examples of such recliner chairs may be seen in U.S. Pat. Nos. 3,044,827; 3,433,527; 3,858,932; 3,941,417; and U.S. Pat. No. Re. 29,483.

It is also knwon to automate the operation of recliner chairs with the use of motor drive means. Typically, the motor drive means may comprise an electric motor affixed to the base and having a gear reduction box and power screw output. The free end of the power screw may be connected to a portion of the linkage mechanism or seat assembly so that rotation of the screw causes motion, extension and/or retraction, of the seat-footrest assembly.

Understandably, the use of motorized power screw drives to operate recliner chairs provides a number of advantages. For example, the chair occupant is no longer required to exert physical force to operate the chair. Also the motor drive can be stopped at will to retain the seat at any intermediate position between full upright and full recline, an operation not generally achievable with a manually operated linkage mechanism which typically provides only two or three fixed balance points. However, it has now been recognized that a purely motorized recliner chair can give rise to certain problematic or serious situations.

Those skilled in the art will appreciate that a practical power screw drive operates at a reduced rate of rotation which is usually provided by gear reduction means. As a result, the movements of a motorized chair are considerably slower than those of a manually operated chair. Emergency situations frequently occur which dictate that the chair occupant arise from the chair as quickly as possible. For example, a doorbell, a child's cry, the ringing of a telephone, or the like, would dictate prompt return of the chair to the upright position with the speed that can be obtained only by manual operation.

Another situation which could occur is the malfunction of the motor or loss of electric power. Under those conditions, it is quite difficult, and even dangerous, for an occupant to try and get out of a chair which is in the recline position.

There thus exists a need for a motorized recliner chair having means for selectively decoupling the motor drive to convert the chair to manual operation. The decoupling means should be substantially fail-safe, simple to operate and add little if any to the total cost of the chair.

SUMMARY OF THE INVENTION

The present invention provides a motorized recliner chair with a power screw drive having means for disengaging or decoupling the motor drive. The decoupling means enables the chair occupant to readily switch to manual operation whenever such mode of operation is desired.

Briefly, the invention comprises a power transfer or drive tube rigidly attached to portions of the linkage actuator mechanism beneath the chair seat. A threaded nut is mounted in the tube and nut retention means is provided for captively retaining the nut in the tube adjacent the rearward end thereof. The nut is of complementary configuration with the cross-section of the tube and non-rotatable therein. At the same time, the nut is dimensioned so that it is freely slidable in the tube, but for the captive retention means. An electric motor is fixedly mounted on the chair base and the power screw drive thereof is threadedly engaged with the nut so that rotation of the screw causes the captive nut and tube to move with the linkage actuating mechanism to obtain the desired chair position.

The nut retention means comprises a fixed rear element and a front latch element which is moveable but is normally spring-urged into engagement with the front of the nut. A pull ring is operationally connected to the latch element and is conveniently located so that the occupant can disengage the latch element from the front of the nut. Since the nut, and threadedly engaged power screw, is freely slidable in the tube, the occupant is now able to manually operate the chair to quickly return to the upright position.

Numerous other advantages and features of the present invention will become readily apparent from the following detailed description of the invention, from the claims, and from the accompanying drawings.

BRIEF DESCRIPTION OF THE DRAWINGS

In the accompanying drawings forming a part of the specification, and in which like numerals are employed to designate like parts throughout the same.

DETAILED DESCRIPTION OF THE INVENTION

Figure 1:
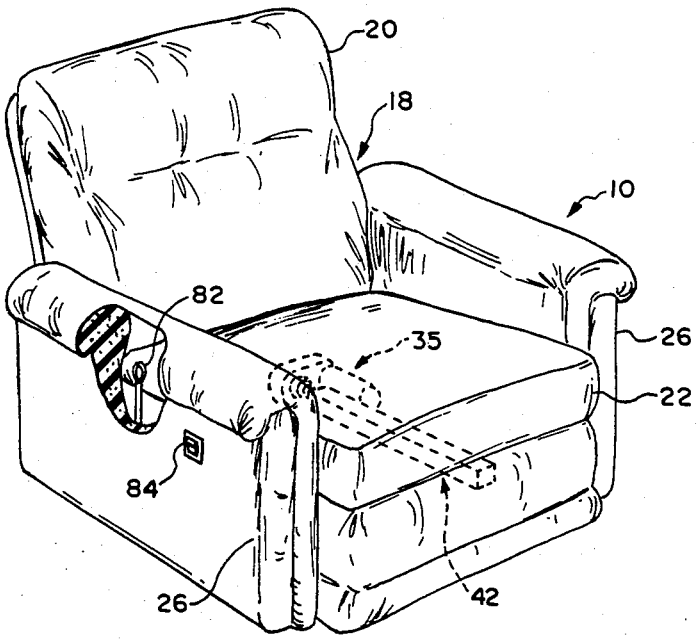
FIG. 1 is a perspective view of a representative recliner chair embodying the principles of the invention.
Figure 2:
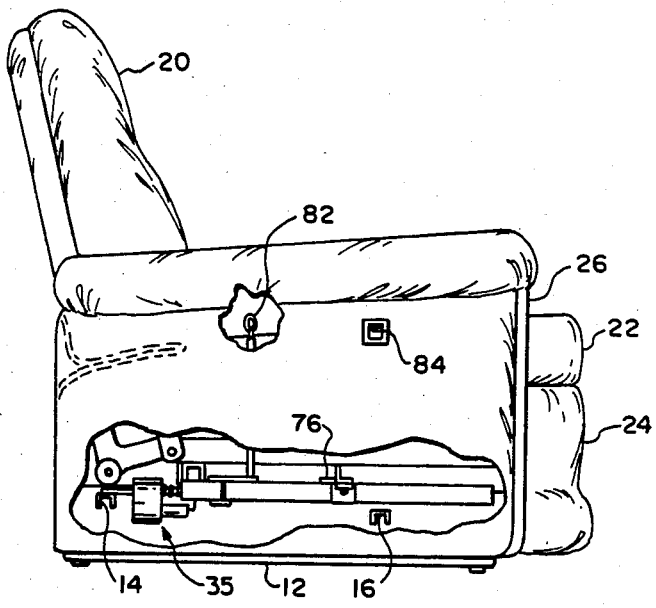
FIG. 2 is a side elevational view of the chair of FIG. 1, with portions broken away to better disclose the relationship of parts, and illustrating the chair in the upright position.
Figure 3:
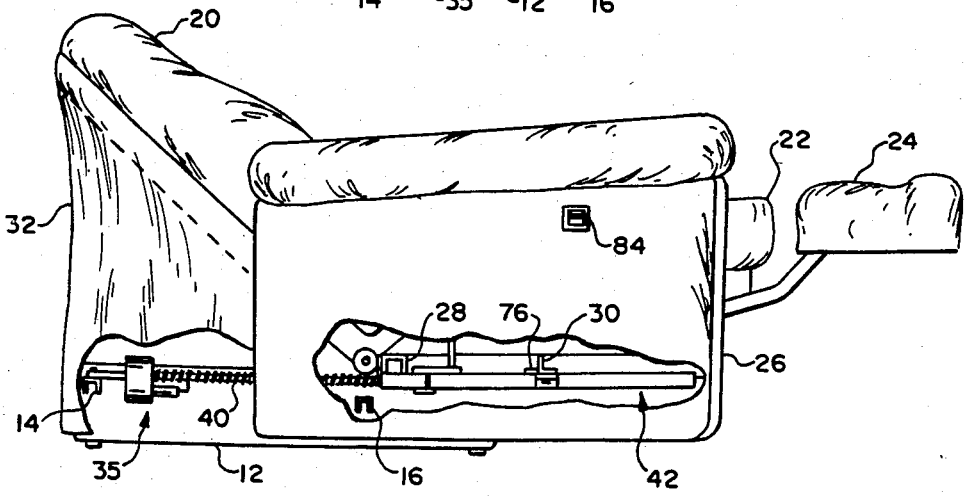
FIG. 3 is a similar view showing the chair in the full recline position.
Figure 4:
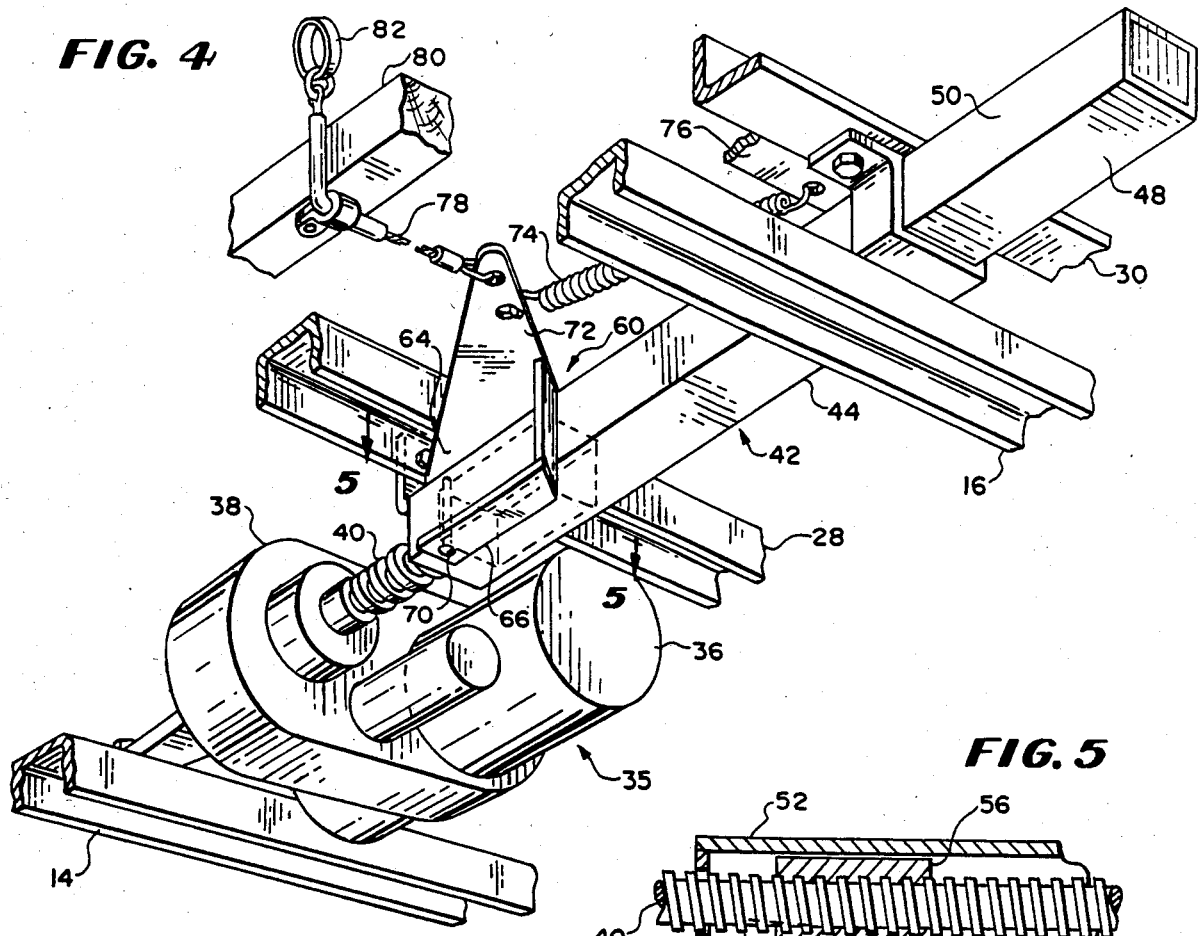
FIG. 4 is an enlarged, fragmentary perspective view, from beneath the chair, of the motorized drive and decoupling members of the invention and showing the power drive engaged.
Figure 5:
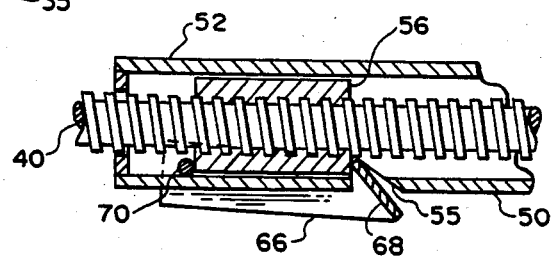
FIG. 5 is a horizontal sectional view on the plane of line 5—5 in FIG. 4.
Figure 6:
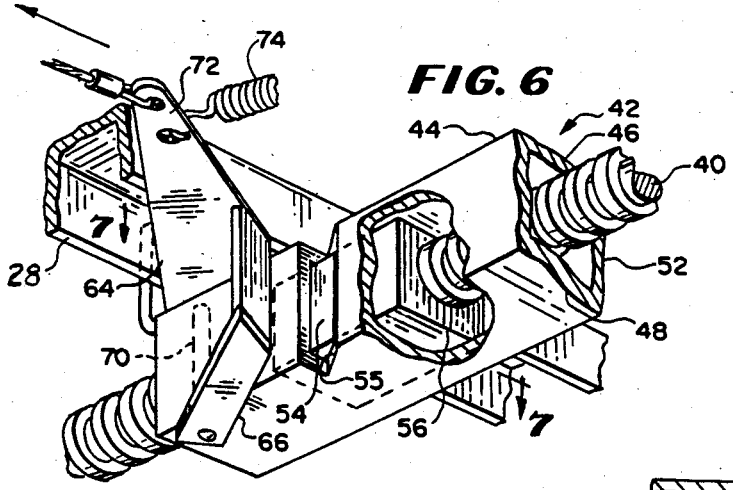
FIG. 6 is a further enlarged fragmentary perspective view similar to FIG. 4, but showing the power drive decoupled.
Figure 7:
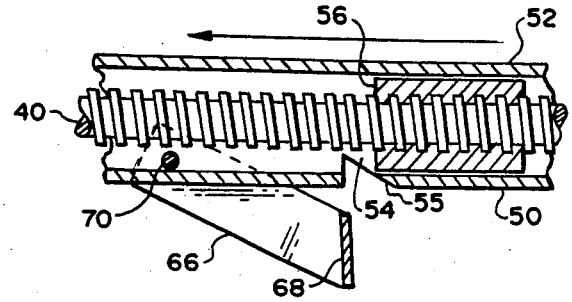
FIG. 7 is a horizontal sectional view on the plane of line 7—7 in FIG. 6.

As already indicated above, the expression "recliner chair" as used herein is intended to apply to all forms of motion seats. In the specific embodiment of recliner chair illustrated and to be described the operating linkage mechanism is of the type knwon in the industry as a "Wall-A-Way", namely, one wherein the linkage is actuated by movement of the arms from the upright sitting position. An example of this type of operation may be seen in U.S. Pat. No. Re. 29,483. It should be understood, however, that the invention applies eqally to other forms of recliner chair operation and linkage actuating means as will be apparent to those skilled in the art from the following description. Moreover, since the particular form of the chair does not per se comprise a part of the invention, only so much thereof as is necessary for an understanding of the invention will be described in detail.

Referring now in greater detail to the various Figures of the drawings, it will be seen that the reference numeral 10 indicates generally a recliner chair embodying the principles of the invention. Recliner chair 10 comprises a stationary base 12, having structural members or stretchers, such as rear stretcher 14 and front stretcher 16, interconnecting the left and right sides thereof. A seat-footrest assembly 18, comprising a back 20, a seat 22 and a footrest 24, is movably mounted on the base 12 by means of a conventional linkage mechanism (not shown). A pair of arms 26, 26, is operationally connected to the linkage mechanism and is adapted to move forwardly and rearwardly with respect to the base 12 for actuating the linkage mechanism, thereby moving the seat-footrest assembly 18 between upright and recline positions in manner well known to the art. The arms 26, 26, are interconnected by structural members, such as rear stretcher 28 and front stretcher 30. Chair 10 may also comprise an upholstery material drape 32 for cosmetically covering the portions of the base and linkage mechanism otherwise exposed when the chaair is reclined. Particular details of other recliner chairs may vary, but the elements of the chair 10 thus far described may be considered conventional.

Motorized drive means 35 is mounted in the chair 10 for moving the same between upright and recline positions. The motorized drive means 35 comprises an electric motor 36 fixedly mounted on the base rear stretcher 14 and including suitable gear reduction means 38 and a power screw 40.

A power transfer or drive housing 42 is operationally associated with the power screw 40. Drive housing 42 comprises an elongated, rectangular tube 44 having top and bottom walls 46 and 48 and side walls 50 and 52. The tube 44 is rigidly connected to the arm stretchers 28 and 30 so that the same extends longitudinally beneath the seat 22 and in registry with the power screw 40. The side wall 50 is formed with a latching slot 54 having a forwardly angled face 55 proximal to the rear end thereof for reasons which will become apparent as the description proceeds.

An elongated drive nut 56 is threadedly engaged on the power screw 40 and is positioned within the tube 44. The nut 56 is rectangular in section and non-rotatable in the tube 44. It is important to note, however, that the nut 56 is of smaller cross-sectional dimension than the tube 44 and thus capable of sliding movement therein; or, contrariwise, the tube 44 is capable of sliding over the nut 56.

Latching means 60 is operationally associated with the tube 44 and nut 56. Latching means 60 comprises a clevis-like member 62 having parallel legs 64 and 66 interconnected by a vertical latching arm 68, said latching arm being angled and flat as illustrated in FIGS. 5 through 10. A retaining pin 70 pivotally connects the free ends of the legs 64 and 66, said pin passing through the walls 46 and 48 of the tube 44 and serving to retain the nut 56 by limiting rearward movement thereof.

A lever plate 72 extends horizontally from the leg 64 and a biasing spring 74 is connected between the plate 72 and an extension 76 of the front arm stretcher 30, thereby normally urging the plate forwardly. As illustrated in FIGS. 4, 5, 8 and 9, the normal bias of the plate 72 causes the latching arm 68 to enter the slot 54 and project partially into the tube 44. The arm 68 thus cooperates with the pin 70 to retain the nut 56 therebetween and prevent longitudinal movement of said nut.

A latch release cable 78 is connected to an extremity of the lever plate 72 ans said cable is suitably mounted from a frame member portion 80 of the seat 22 and carries at its free end a pull ring 82 which is conveniently located for ready grasping by the occupant of the chair. An electrical switch 84 is likewise mounted on a chair arm 26 for ready access by the chair occupant, said switch comprising a normally open, two-position switch for selectively operating the motor 36 in forward and reverse directions.

Figure 8:
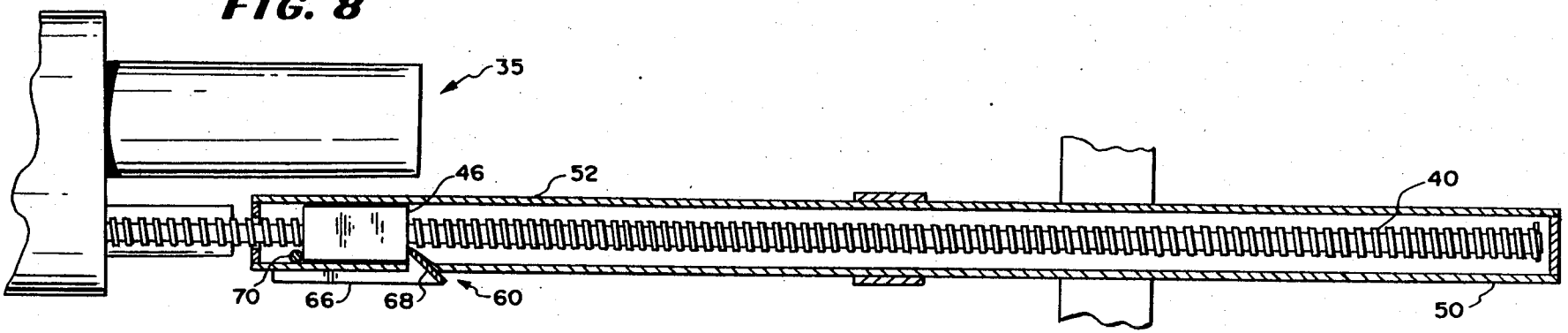
FIG. 8 is a schematic horizontal sectional view showing the relationship of parts with the power drive engaged and the chair in the upright position.
Figure 9:
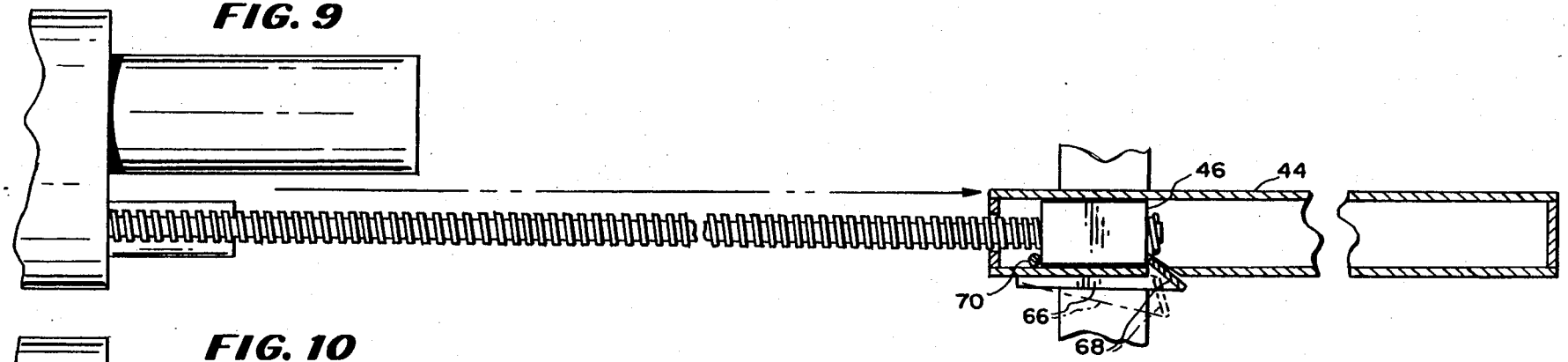
FIG. 9 is a similar view showing the relationship of parts with the chair in the full recline position.
Figure 10:
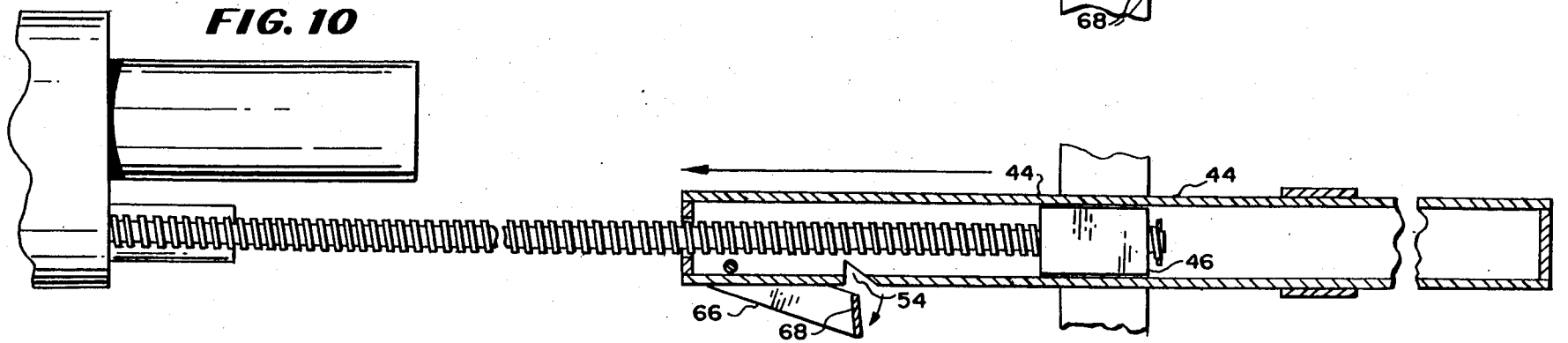
FIG. 10 is a similar view showing the relationship of parts with the power drive disengaged and the chair being manually returned from the recline to the upright position.

Operation of the chair may now best be understood by referring to FIGS. 8–10 of the drawings. With the chair in the upright position, the drive tube 42 is in its rearwardmost position, along with the arms 26, and the nut 56 is captively retained in the tube 44 by the pin 70 and latching arm 68 as shown in FIG. 8. Operation of the switch 84 by the chair occupant causes rotation of the power screw 40 resulting in forward movement of the nut 56, drive housing 42 and arms 26 to actuate the linkage mechanism and move the seat-footrest assemby 18 toward the recline position as illustrated in FIG. 9. When manual operation is desired, the occupant may pull on the pull ring 82 to withdraw the latching arm 68 from the slot 54 in the tube 44, whereupon the nut 56 is now free to slide forwardly in the tube 44. The chair may now be operated manually in the usual manner by pulling on the arms 26 and/or pressing down with the legs on the footrest 24 to quickly bring the chair back to the upright position, as illustrated in FIG. 10.

Re-engagement of the nut 56 and drive housing 42 with the power screw 40 may be readily achieved either by manually operating the chair to the previous recline position or by operating the switch 84 in reverse direction to return the nut 56 to the latched captive position. In either event, the cooperation of the slot 54 with angled face 56, the angled latching arm 68 and the spring bias of the lever plate 72 permits the nut 56 in its rearward movement to snap back into the engaged position.

The invention may include other electrical safety features not shown, such as, an override switch in the seat which is responsive to the weight of an occupant so that the chair may not be operated without a seated occupant, and limiting switches to appropriately limit the longitudinal travel of the nut 56 on the power screw. It should also be appreciated that the drive housing 42 could likewise be attached directly to the frame of the seat 22 instead of the actuating arms 26 in which event the motor 36 may be mounted on the base stretcher with a pivotal connection to permit the drive means to follow the movement of the seat.

It will be readily observed from the foregoing detailed description of the invention and the illustrative embodiment thereof that numerous variations and modifications may be effected by those skilled in the art without departing from the true spirit and scope of the novel concept of the principles of the invention.

What is claimed is:

1. In a recliner chair having a base, a seat-footrest assembly mounted on the base and movable between upright and recline positions and mechanical linkage operational for moving the seat-footrest assembly, motor drive means mounted to said base and connected to the mechanical linkage by a spring biased decoupling means to actuate said mechanical linkage; and said spring biased decoupling means operable by an occupant of the chair for disengaging said motor drive means from said mechanical linkage so that the occupant can manually move said seat-footrest assembly independently of said motor drive means.

2. In a recliner chair according to claim 1, said motor drive means comprising an electric motor fixedly mounted on said base and including a forwardly projecting power screw drive, and power transfer means operatively associated with said screw drive for transfering the rotation of said screw to actuate said mechanical linkage.

3. In a recliner chair according to claim 2, said power transfer means comprising an elongated rigid housing, a threaded connector mounted on said power screw and positioned in said housing and connector retention means in said housing preventing movement of said connector in said housing, whereby rotation of said power screw causes concomitant longitudinal movement of said connector and housing.

4. In a recliner chair according to claim 3, said housing comprising a rectangular tube and said connector comprising a rectangular nut non-rotatable but slidable in said tube.

5. In a recliner chair according to claim 4, said tube comprising a slot through a wall thereof, said connector retention means comprising a pin in said tube adjacent the rearward end thereof and adapted to engage the rear end of said nut and a latching arm projecting into said tube through said slot and adapted to engage the front end of said nut.

6. In a recliner chair according to claim 5, said decoupling means comprising said latching arm, a lever connected to said latching arm and pivotally associated with said tube, spring means connected to said lever and normally urging said latching arm into said slot and pull means connected to said lever and operable by a chair occupant to withdraw said latching arm from said slot so that said nut is forwardly slidable in said tube.

7. In a recliner chair according to claim 6, said decoupling means comprising a clevis-like member having a pair of parallel legs interconnected by said latching arm, the free ends of said legs being pivotally connected to said tube with said pin.

8. In a recliner chair according to claim 3, linkage actuating means comprising a pair of interconnected arms operatively associated with said linkage, said housing being rigidly connected to said linkage actuating means whereby movement of said housing causes actuation of said linkage.

9. A recliner chair comprising:

a stationary base including a rear stretcher;

a seat-footrest assembly;

linkage mechanism mounting said seat-footrest assembly on said base for movement between upright and recline positions;

linkage actuating means operatively associated with said linkage mechanism for actuating said linkage mechanism;

an electric motor fixedly mounted on said rear stretcher and including a forwardly projecting power screw drive;

power transfer means rigidly connected to said linkage actuating means and connected to said power screw by a spring biased decoupling means for moving said linkage actuating means; and said spring biased decoupling means operable by a chair occupant for disengaging said power screw from said power transfer means whereby the chair occupant may selectively manually operate said linkage actuating means independently of said power screw to move said seat-footrest assembly.

10. A recliner chair according to claim 9 wherein said power transfer means comprises an elongated rectangular tube, an elongated rectangular nut threadedly engaged on said power screw, said nut being positioned in said tube and non-rotatable but slidable therein, and nut retention means in said tube engaging said nut and preventing movement thereof, whereby said nut and tube move longitudinally as a unit responsibe to the rotation of said screw.

11. A recliner chair according to claim 10 wherein said nut retention means comprises a pin in said tube adapted to engage the rear wall of said nut, a slot formed in a wall of said tube spaced forwardly of said pin, and a latching arm projecting through said slot into said tube and adapted to engage the front wall of said nut, said pin and latching arm cooperating to prevent longitudinal movement of said nut in said tube.

12. A recliner chair according to claim 11 wherein said decoupling means comprises a pair of parallel legs at opposite ends of said latching arm, said legs being pivotally mounted on said tube, a lever plate projecting from one of said legs, spring means connected between said lever plate and linkage actuating means and normally biasing said latching arm into said slot, a pull cable connected to said lever plate and carrying a pull ring at the free end thereof, said pull ring being operable by a chair occupant to pivot said latching arm out of said slot whereupon said nut is forwardly slidable in said tube and said linkage actuating means may be manually operated to move said seat-footrest assembly.

13. A recliner chair according to claim 12 wherein said linkage actuating means comprises a pair of side arms movable on said base, and stretchers interconnecting said side arms, said tube being rigidly connected to said stretchers.

14. A recliner chair according to claim 12 wherein the free ends of said parallel legs are pivotally mounted on said tube by said pin.

15. A recliner according to claim 14 wherein said slot comprises an angle face and said latching arm comprises a flat member of substantially complementary angle, whereby said nut when moved rearwardly in said tube snaps past the latching arm projecting into the tube and back into retaining engagement by said pin and latching arm.

* * * * *